US007530474B2

(12) United States Patent
Amron

(10) Patent No.: US 7,530,474 B2
(45) **Date of Patent: *May 12, 2009**

(54) WATER DISCHARGING DEVICES

(75) Inventor: Alan B. Amron, Brooklyn, NY (US)

(73) Assignee: Tropical Ventures LLC, Hemstead, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/262,877

(22) Filed: Oct. 31, 2005

(65) Prior Publication Data

US 2006/0261189 A1 Nov. 23, 2006

Related U.S. Application Data

(63) Continuation-in-part of application No. 11/143,353, filed on Jun. 2, 2005, now Pat. No. 7,475,832, which is a continuation-in-part of application No. 11/136,693, filed on May 23, 2005, now Pat. No. 7,458,485.

(51) Int. Cl.
*A63H 3/18* (2006.01)

(52) U.S. Cl. ..... 222/79; 239/263; 239/264; 239/222.15; 239/227

(58) Field of Classification Search ..... 222/79; 239/263, 264, 227, 525, 237, 222.15, 222.12
See application file for complete search history.

(56) References Cited

U.S. PATENT DOCUMENTS 1,150,940 A * 8/1915 Irish ..... 239/494
1,798,488 A 3/1931 Fingal
1,941,786 A 1/1934 Carley et al.
2,381,740 A 9/1945 Grelson
2,794,292 A 3/1957 Noble
2,830,739 A 4/1958 Moye
2,998,166 A 8/1961 Klawiter
3,399,638 A 9/1968 Bishop et al.
3,493,179 A 2/1970 Hsuen
3,556,689 A 1/1971 Hechler
3,804,336 A * 4/1974 Koeppe ..... 239/383
4,335,677 A 6/1982 Nagata
4,397,879 A 8/1983 Wilson
4,542,853 A * 9/1985 Diamond ..... 239/383
4,615,488 A 10/1986 Sands
4,709,691 A * 12/1987 Lemons et al. ..... 601/160
4,821,961 A 4/1989 Shook
4,842,200 A 6/1989 Hermansson
4,989,786 A * 2/1991 Kranzle et al. ..... 239/240
5,024,382 A 6/1991 Shook et al.
5,060,863 A 10/1991 Hammelmann
5,086,974 A 2/1992 Henshaw (Continued)

*Primary Examiner*—Len Tran
*Assistant Examiner*—Trevor E McGraw
(74) *Attorney, Agent, or Firm*—Cohen Pontani Lieberman & Pavane LLP

(57) ABSTRACT

A water discharging amusement device incorporates a housing defining an interior chamber, an inlet conduit dimensioned and arranged to receive water from a source of pressurized water and to direct received pressured water into the interior chamber, a rotatable nozzle assembly dimensioned and arranged to spin while receiving pressurized water from the interior chamber and to eject a substantially spiral stream of water as it spins, and a drive assembly disposed within the chamber and dimensioned and arranged to convert linear forces imparted by pressurized water arriving via the inlet into rotary forces for rotating the rotatable nozzle.

18 Claims, 5 Drawing Sheets

U.S. PATENT DOCUMENTS 5,104,043 A 4/1992 Pacht
5,224,652 A 7/1993 Kessler
5,244,153 A 9/1993 Kuhn et al.
5,297,979 A * 3/1994 Amron ..... 446/16
5,392,968 A 2/1995 Dark
5,395,053 A 3/1995 Frech
5,427,320 A 6/1995 Mak et al.
5,433,646 A 7/1995 Tarng
5,456,413 A 10/1995 Ellis
5,505,380 A 4/1996 Jun
5,577,945 A 11/1996 LaBelle
5,582,532 A 12/1996 Tucker
5,586,688 A 12/1996 Johnson et al.
5,595,345 A 1/1997 Chura
5,667,138 A 9/1997 Crampton
5,674,323 A 10/1997 Garcia
5,725,680 A 3/1998 Mathieus
5,826,250 A 10/1998 Johnson
5,865,344 A * 2/1999 Nagel ..... 222/79
5,878,914 A 3/1999 Johnson
6,007,003 A 12/1999 Wang
6,129,293 A * 10/2000 Jager ..... 239/227
6,151,824 A 11/2000 Clayton
6,155,494 A 12/2000 Fabbri et al.
6,186,367 B1 2/2001 Harrold
6,196,475 B1 * 3/2001 Jaeger ..... 239/381
6,199,771 B1 * 3/2001 Clearman et al. ..... 239/222.11
6,250,506 B1 6/2001 Geiger et al.
6,331,130 B1 12/2001 Thai
6,364,162 B1 4/2002 Johnson et al.
6,422,480 B1 * 7/2002 Richmond ..... 239/10
6,474,507 B1 11/2002 Hornsby
6,540,108 B1 4/2003 Johnson
6,594,843 B1 * 7/2003 Wilkins ..... 15/24
6,676,037 B2 * 1/2004 Marks ..... 239/237
6,719,218 B2 4/2004 Cool
6,766,967 B2 * 7/2004 Harris et al. ..... 239/251
6,892,902 B2 5/2005 Hornsby
6,899,286 B2 5/2005 Blessing
6,935,531 B1 8/2005 Clayton
6,959,838 B2 11/2005 Eddins et al.
7,032,837 B2 4/2006 Eddins et al.
7,097,073 B2 8/2006 Zimmerman
7,111,795 B2 9/2006 Thong
7,131,557 B2 11/2006 Zimmerman et al.
7,182,477 B1 2/2007 Hartz
7,185,787 B2 3/2007 Brown et al.
2001/0019083 A1 * 9/2001 Marks ..... 239/225.1
2002/0030066 A1 3/2002 McKenna
2002/0090878 A1 7/2002 Holmes
2003/0071141 A1 4/2003 Rieben
2003/0085303 A1 5/2003 Jaeger
2004/0164090 A1 8/2004 Eddins et al.
2005/0035148 A1 2/2005 Zimmerman
2005/0173559 A1 8/2005 Eddins et al.
2006/0065760 A1 3/2006 Micheli

* cited by examiner

WATER DISCHARGING DEVICES

REFERENCE TO RELATED APPLICATIONS

This application is a continuation-in-part of U.S. patent application Ser. No. 11/143,353, entitled PORTABLE WATER DISCHARGING AMUSEMENT DEVICE AND RELATED METHODS, filed on Jun. 2, 2005, now U.S. Pat. No. 7,475,832, which is a continuation-in-part of U.S. patent application Ser. No. 11/136,693, entitled WATER GUN AMUSEMENT DEVICES AND METHODS OF USING THE SAME, filed on May 23, 2005, now U.S. Pat. No. 7,458,485.

FIELD OF THE INVENTION

The present invention relates generally to water discharging devices and, more particularly, to systems adapted to discharge water in a pattern suitable for children to jump into or through during play.

DISCUSSION OF THE BACKGROUND ART

Water play toys have long been a source of great amusement and recreation value. In summer months in particular, toys which combine action and the use of water have provided diversion and a source of cooling at the same time. It has frequently been a favorite pastime of children to play using lawn sprinklers and the like by turning the sprinklers on and running through them. Even simply turning on a garden hose and squirting play companions has been popular attesting to the fascination that children have for water and water play.

In U.S. Pat. No. 5,297,979 issued to the inventor herein, Alan Amron, on Mar. 29, 1994, there is disclosed a water sprinkler having a housing that is formed into the shape of a dolphin and that includes a plurality of rotating sprinkler heads for providing a spray of water when the device is connected to a typical garden hose. A water-turbine powered mechanism within the housing generates bubbles which are released through an opening at the top of the housing so that children can jump and play within a spray of water having bubbles interspersed therein.

A reaction type of water sprinkling toy is shown in U.S. Pat. No. 3,700,172. Water communicated by a hose to a housing is conducted through a plurality of internal tubes to spray nozzles opening downwardly from the housing. The force of water emitted by the nozzles causes the housing to lift and hover over the surface on which it is placed at rest. As the term implies, the toy of the U.S. Pat. No. 3,700,172 is one which is caused to rise in reaction to the forces encountered as water passes through the outlet nozzles. Other water reaction toys are also known, including that shown in U.S. Pat. No. 3,079,727 and known as the Water Wiggle. The action/reaction principle is also graphically illustrated by a hose having a constricted outlet which writhes like a snake when a source of water pressure is connected to the hose.

Other toys that generate a spray of water for play purposes are disclosed by Janszen, U.S. Pat. No. 4,573,679 and by Stanley, U.S. Pat. No. 4,205,785. Despite the variety of existing water discharging amusement devices, a continuing need exists for amusement devices which are especially suitable for children's play, which are especially attractive to children, which are easy to use, which does not use excessive amounts of water—especially in areas where water conservation is encouraged, and which is inexpensive and effective in distributing a pleasant and satisfying shower of water.

SUMMARY OF THE INVENTION

The aforementioned needs are addressed, and an advance is made in the art, by water discharging amusement devices that incorporate a housing defining an interior chamber, an inlet conduit dimensioned and arranged to receive water from a source of pressurized water and to direct received pressured water into the interior chamber, a rotatable nozzle assembly dimensioned and arranged to spin while receiving pressurized water from the interior chamber and to eject a substantially spiral stream of water as it spins, and a drive assembly disposed within the chamber and dimensioned and arranged to convert linear forces imparted by pressurized water arriving via the inlet into rotary forces for rotating the rotatable nozzle.

In accordance with an illustrative embodiment of the invention, the drive assembly is disposed proximate said inlet and comprises a turbine including a rotatable disk having a plurality of vanes defined thereon. The inlet conduit may include a first portion defining a first bore having a first diameter dimensioned for threaded engagement with a garden hose and a second portion defining a second bore having a second diameter substantially smaller than the first diameter, the second portion operating as a capillary tube to limit a rate at which water enters the interior chamber and impinges upon the vanes of the turbine.

Depending upon the orientation and position of the discharge opening of the nozzle assembly relative to the orientation and position of the inlet, it may be necessary to incorporate additional elements in the drive assembly. For example, if the axis of nozzle rotation is transverse to an axis defined by the inlet flow path, the drive assembly may further include a driven gear wherein the periphery of the driven gear and the turbine may be defined with corresponding teeth. In accordance with such an implementation, the driven gear includes a shaft dimensioned and arranged to extend through a bore in a sidewall of the housing and to freely rotate within that bore. The shaft is coupled to the rotatable nozzle assembly for rotation therewith and defines a discharge conduit extending therethrough for establishing fluid communication between the interior chamber and the discharge opening of the rotatable nozzle assembly.

Water discharging devices constructed in accordance with the present invention may be realized in a variety of configurations. For example, in sprinkler embodiments, the housing may be configured as a base dimensioned and arranged to support the rotatable nozzle assembly in a substantially vertical orientation. This results in an upwardly directed spiral stream of water which is attractive and interesting to children during play. Other possible configurations include hand-held, hose end nozzles, wherein the device further includes a valve selectively operable between a first position permitting flow of water from the discharge opening of the rotary nozzle assembly and a second position preventing flow of water from the discharge opening. The hand held nozzle configurations of the present invention further include a hand operated trigger dimensioned and arranged to manipulate the valve into either of the first position and the second position.

Amusement devices constructed in accordance with the aforementioned illustrative sprinkler embodiments may include two or more rotatable nozzle assemblies, each being adapted to rotate about a correspondingly different axis of rotation. As will be readily appreciated by those skilled in the art, such an arrangement may be readily achieved using the disk member of the turbine to drive a plurality of driven gear members, with each gear member defining a separate discharge conduit as described above.

BRIEF DESCRIPTION OF THE DRAWINGS

The various features and advantages of the present invention would be better understood by reference to the detailed description which follows, taken in conjunction with the accompanying drawings, in which.

DETAILED DESCRIPTION OF THE INVENTION

The accompanying Figures and this description depict and describe embodiments of a water sprinkler amusement device in accordance with the present invention, and features and components thereof. The present invention also encompasses a method of making and using embodiments of the amusement device. As used herein, the phrases or terms "water discharging device," "sprinkler," "water discharging amusement device" and the like are intended to encompass a structure or structures configured to automatically project, throw, squirt, launch or shoot water upwardly or laterally into the air so that it falls down upon a child during play, and which can be operated when attached to the end of a garden hose. It should also be noted that any references herein to front and back, right and left, top and bottom and upper and lower are intended for convenience of description, not to limit the present invention or its components to any one positional or spatial orientation.

With regard to fastening, mounting, attaching or connecting components of the present invention to form the water discharging amusement device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. Components may also be connected by adhesives, glues, welding, ultrasonic welding, and friction fitting or deformation, if appropriate, and appropriate liquid and/or airtight seals or sealing devices may be used. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

Figure 1:
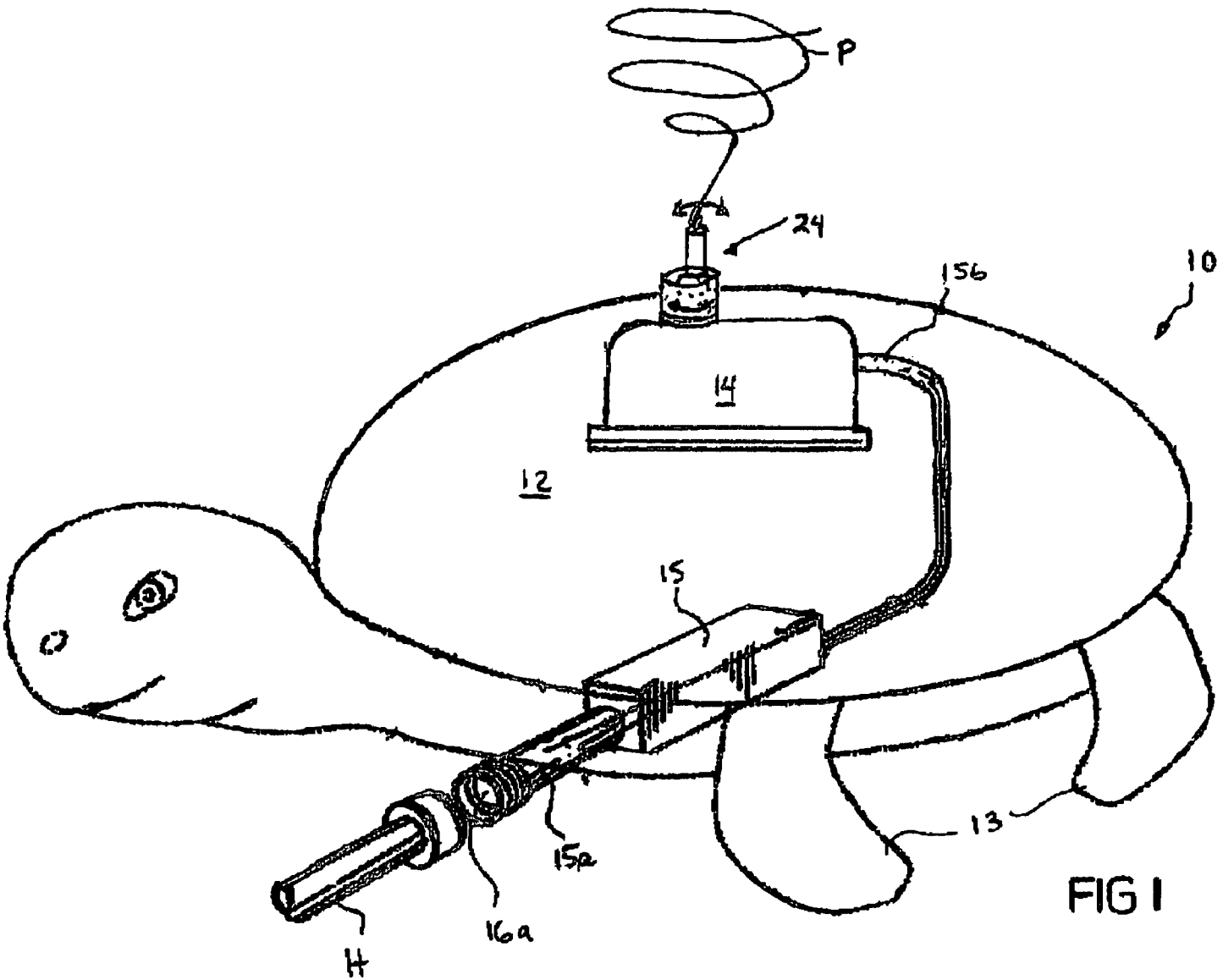
FIG. 1 is a side elevation view depicting a water discharging amusement device constructed in accordance with an illustrative water sprinkler embodiment of the present invention, the device being equipped with a nozzle assembly adapted to rotate automatically, as water is discharged, to produce an upwardly directed helix of water.
Figure 2:
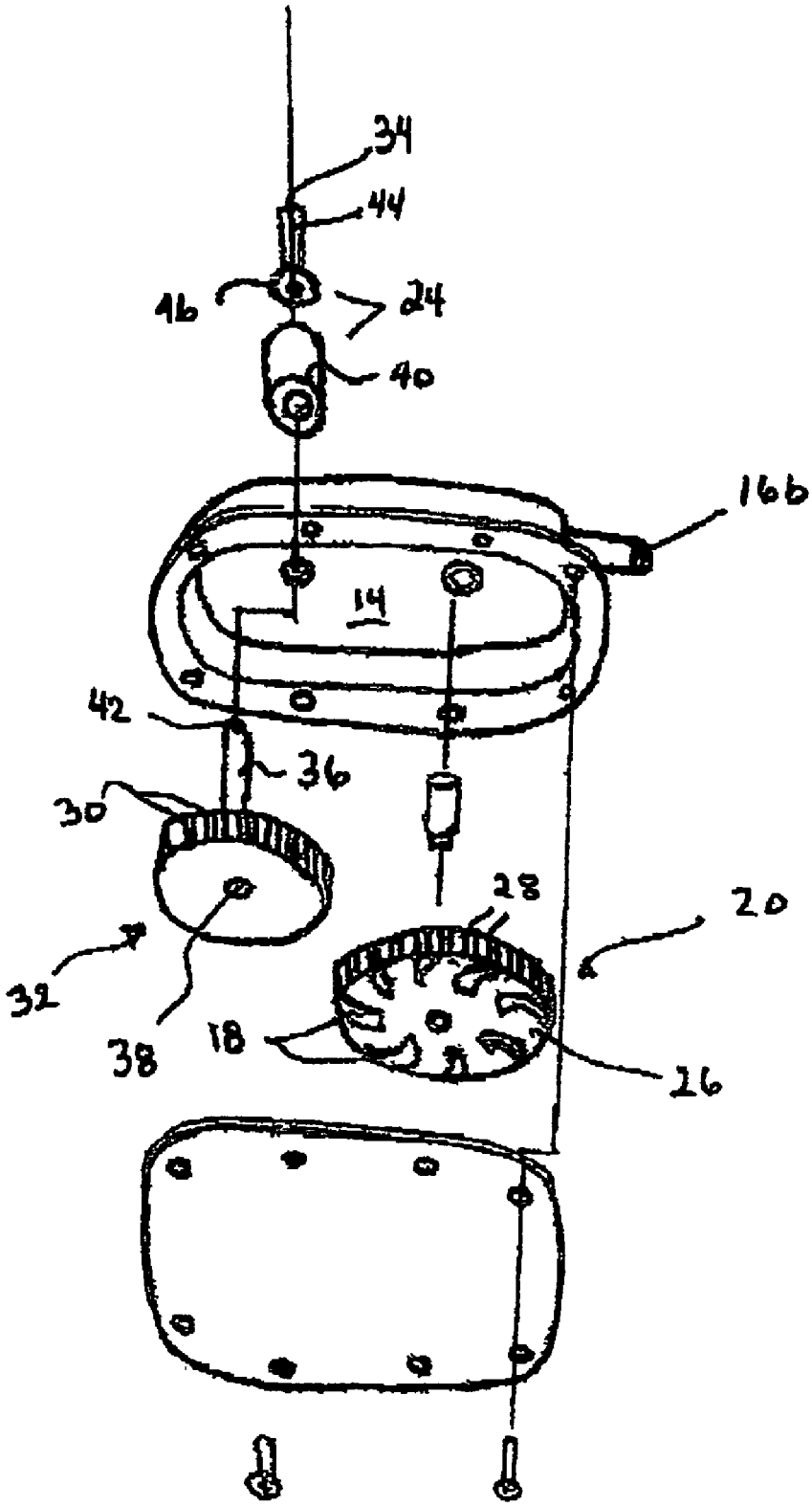
FIG. 2 is an exploded view depicting the internal construction of the exemplary embodiment of FIG. 1.

Turning now to the drawings, in which like elements are denoted by like reference numerals throughout the several views, a first illustrative embodiment of a water discharging amusement device 10 in accordance with the present invention is depicted in FIGS. 1 and 2. The embodiment of FIGS. 1 and 2 include an elongated housing or body 12 having defined therein an interior chamber indicated generally at 14. In the illustrative embodiment, housing 12 has an animal shape having a plurality of downwardly depending legs 13 dimensioned and arranged for stable placement of housing 12 on a lawn or other suitable surface (not shown). An inlet conduit 15 has a first end 15*a* dimensioned and arranged for threaded engagement with the end of a garden hose H and a second end 15*b* which enters chamber 14. A bore extending through conduit 15 has a first portion 16*a* having a first interior diameter conforming, more or less, to the diameter of the interior bore of the garden hose. In the exemplary embodiment of FIGS. 1 and 2, the bore has a second portion 16*b* (FIG. 2) having a second diameter which is selected so as to function as a capillary tube. Illustratively, portion 16*b* may be on the order of about 0.062 inches in diameter. This arrangement has been found to limit the rate of water flow, over an expected range of municipal water pressures, to a level that preserves the spiral appearance of the discharge pattern. In that regard, it should also be noted that the inventor herein has observed that an advantageous arrangement is achieved when the diameter of portion 16*b* is less than the diameter of the orifice through which water is ejected by the device. When using a capillary tube section diameter of 0.062 inches, for example, advantageous results have been achieved with a nozzle orifice diameter of 0.074 inches.

As best seen in FIG. 2, it will be seen that water entering chamber 14 via capillary tube section 16*b* impinges upon the vanes 18 of turbine 20. Essentially, the purpose of turbine 20 is to convert the linear forces imparted by water entering via capillary tube section 16*b* into rotary forces suitable for rotating a rotatable nozzle assembly indicated generally at reference numeral 24. To that end, the peripheral surface of a disk section 26 of turbine 20 defines a series of teeth 28 adapted to engage with corresponding teeth 30 on the peripheral surface of a driven gear assembly 32 that is secured to rotatable nozzle assembly 24. Accordingly, as turbine 20 rotates, driven gear assembly 32 and nozzle assembly 24 also rotate. To allow water to flow from within chamber 14 to the discharge opening 34 of nozzle assembly 24, driven gear assembly includes a shaft 36 that defines an axial discharge conduit 38. This arrangement permits water to pass from chamber 14 directly to the nozzle assembly 24.

With continuing reference to FIG. 2, it will be seen that nozzle assembly 24 comprises a cap member 40 which is secured to the distal end 42 of shaft 36. Within cap member 40 is a discharge tube 44 having a spherical inlet end 46 which is pivotably received within cap member 40 and adapted for pivotable movement therewithin. Such an arrangement permits the divergence of the spiral water stream P (FIG. 1) ejected by nozzle assembly 24 to be quickly and easily adjusted by the user. Specifically, pivoting nozzle end 34 of discharge tube 44 outwardly (i.e., so as to diverge away from the axis of rotation of assembly 24) produces a "tornado" effect in which the layers of water in path P expand outwardly as they rise vertically. The greater the angle of divergence, relative to a vertical axis of rotation, the wider the diameter achieved by each layer of water in the spiral path P. Even greater divergence may be achieved by offsetting the discharge path relative to the axis of rotation. It should be noted that although only one nozzle assembly is depicted in FIGS. 1 and 2, it will be readily appreciated by those skilled in the art that additional nozzle assemblies, as nozzle assembly 24, may be readily incorporated into the device 10.

Figure 3A:
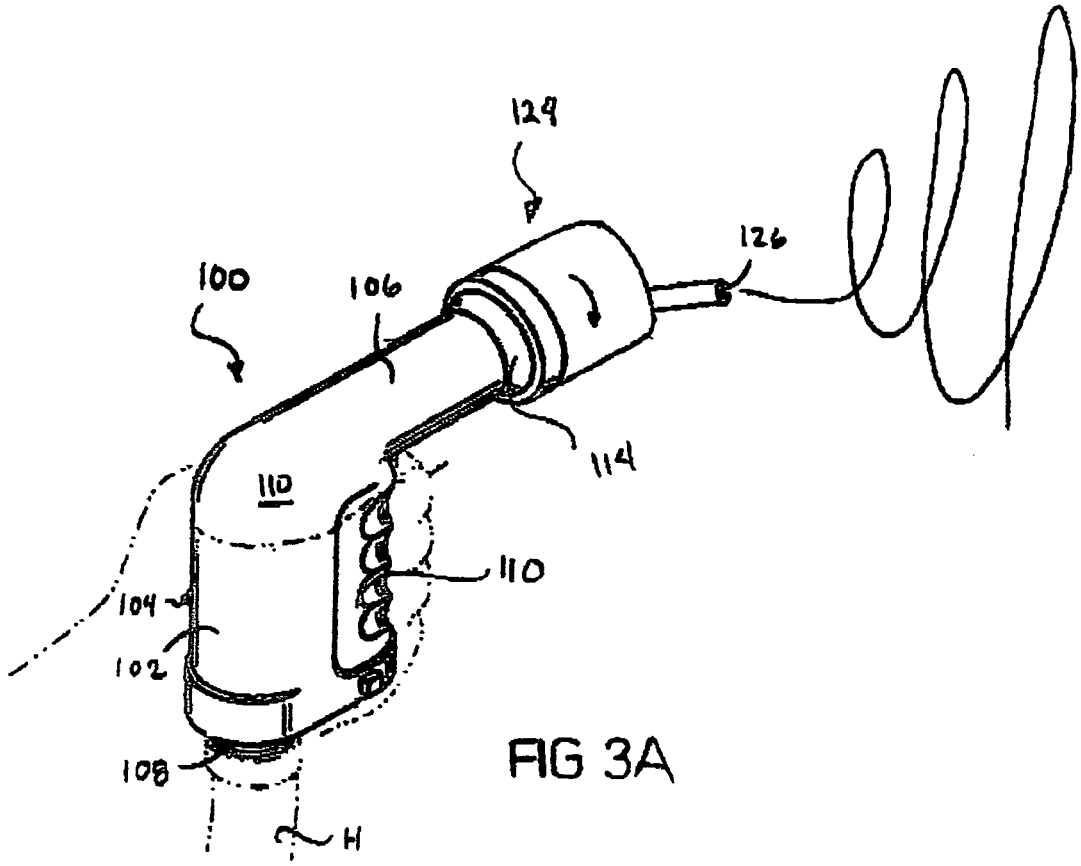
FIG. 3A is an isometric perspective view depicting a water discharging amusement device constructed in accordance with an illustrative hand-held, hose-end nozzle embodiment of the present invention, the device being equipped with a nozzle assembly adapted to rotate automatically, as water is discharged, to produce, for example, a laterally directed helix of water.

Turning now to FIGS. 3A-7, there is shown a hand-held, hose-end nozzle device 100 constructed in accordance with a second illustrative embodiment of the invention. With initial reference to FIGS. 3A and 3B, it will be seen that device 100 comprises a conventional hose end adaptor assembly indicated generally at 110 having a body or housing 102 that includes a handle section 104 and a barrel portion 106. The conventional hose adaptor assembly 110 employed in the illustrative embodiment of FIGS. 3A and 3B is substantially as shown and described in U.S. Pat. No. 5,303,868, issued to Kroll on Apr. 19, 1994 and entitled Hose Nozzle, the disclosure of which is expressly incorporated herein by reference. It should, however, be emphasized that any conventional hose adaptor assembly operative to receive water via a source of municipally pressurized water by way of a hose attachment will suit the purporses of the present invention. Indeed, many conventional hose end nozzle assemblies incorporate not only a threaded inlet or proximal end, but also a threaded discharge or distal end. The latter configurations are especially suited for kit forms of the invention, in which a rotatable nozzle assembly is realized as an adaptor dimensioned and arranged for threaded engagement onto the distal end of a conventional hose end nozzle, rather than as an integrated assembly. In any event, and with continued reference to FIGS. 3A and 3B, water is introduced via an inlet opening 108 dimensioned and arranged for threaded engagement with the end of a conventional garden hose H. Depression of a conventional spring biased trigger, as trigger 110, opens a conventional, normally closed valve (not shown), thereby allowing water through an internal conduit 112 (FIG. 4) that passes through the handle toward a distal end 114 of barrel portion 106.

Figure 3B:
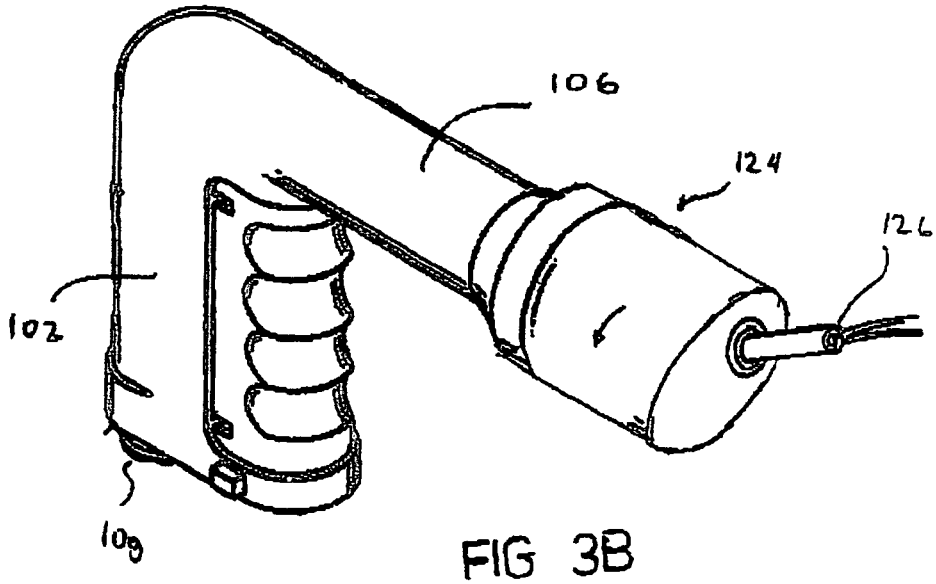
FIG. 3B is a frontal perspective view of the embodiment depicted in FIG. 3A

As in the case of the embodiment of FIG. 1, the embodiment of FIGS. 3A and 3B employs a rotating nozzle 124. While trigger 110 is in the "on" or an "intermediate" depressed position, nozzle assembly 124 rotates and water being discharged through a discharge outlet 126 thereof assumes a spiral trajectory in any direction the user chooses to aim barrel portion 106. Automatic rotation of nozzle assembly 124 to produce a spiral discharge effect can be achieved in a variety of ways. By way example, discharge outlet 126 of nozzle assembly 124 may be dimensioned and arranged to impart a nozzle reaction force—that is offset relative to the axis of nozzle assembly rotation—as the stream of water is discharged. Even a relatively small angle of inclination of the discharge stream relative to a plane orthogonal to the rotational axis of the nozzle assembly is sufficient to induce rotation of the nozzle assembly.

Figure 4:
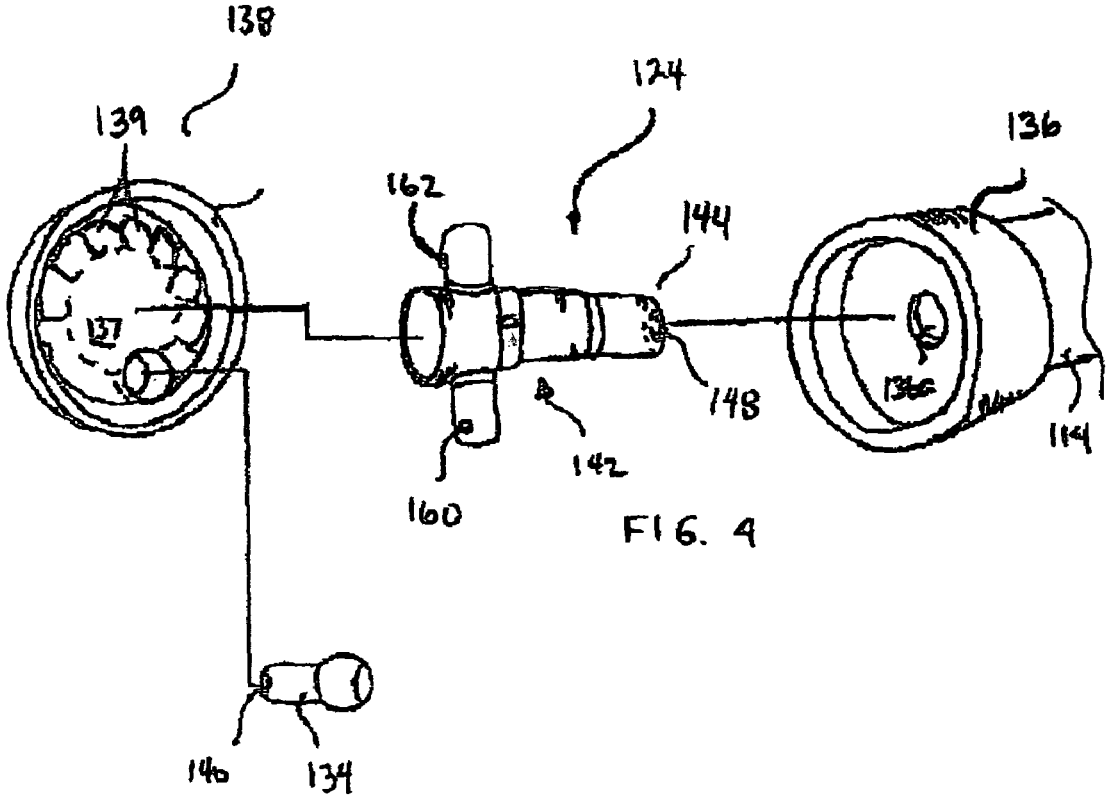
FIG. 4 is a perspective view depicting an exemplary rotating nozzle assembly utilized in the embodiment of FIG. 3A.
Figure 5:
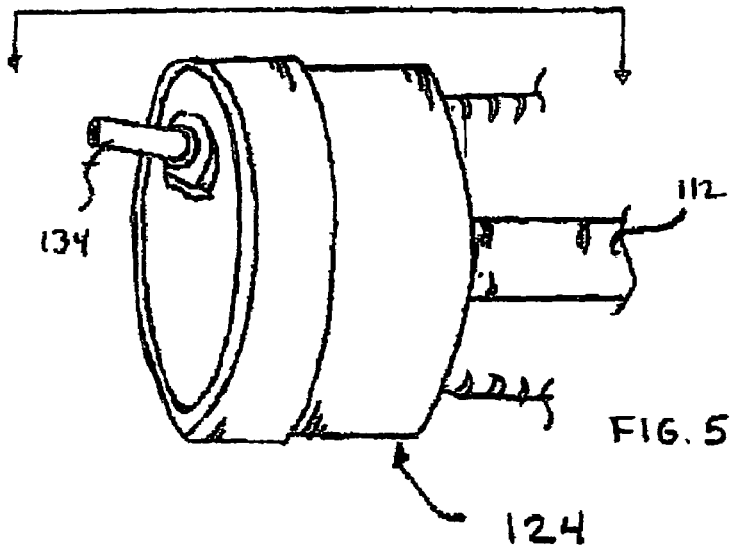
FIG. 5 is a broken apart, perspective view depicting the internal construction of an exemplary, rotating nozzle assembly for use in realizing the illustrative embodiment of FIG. 3A.
Figure 6:
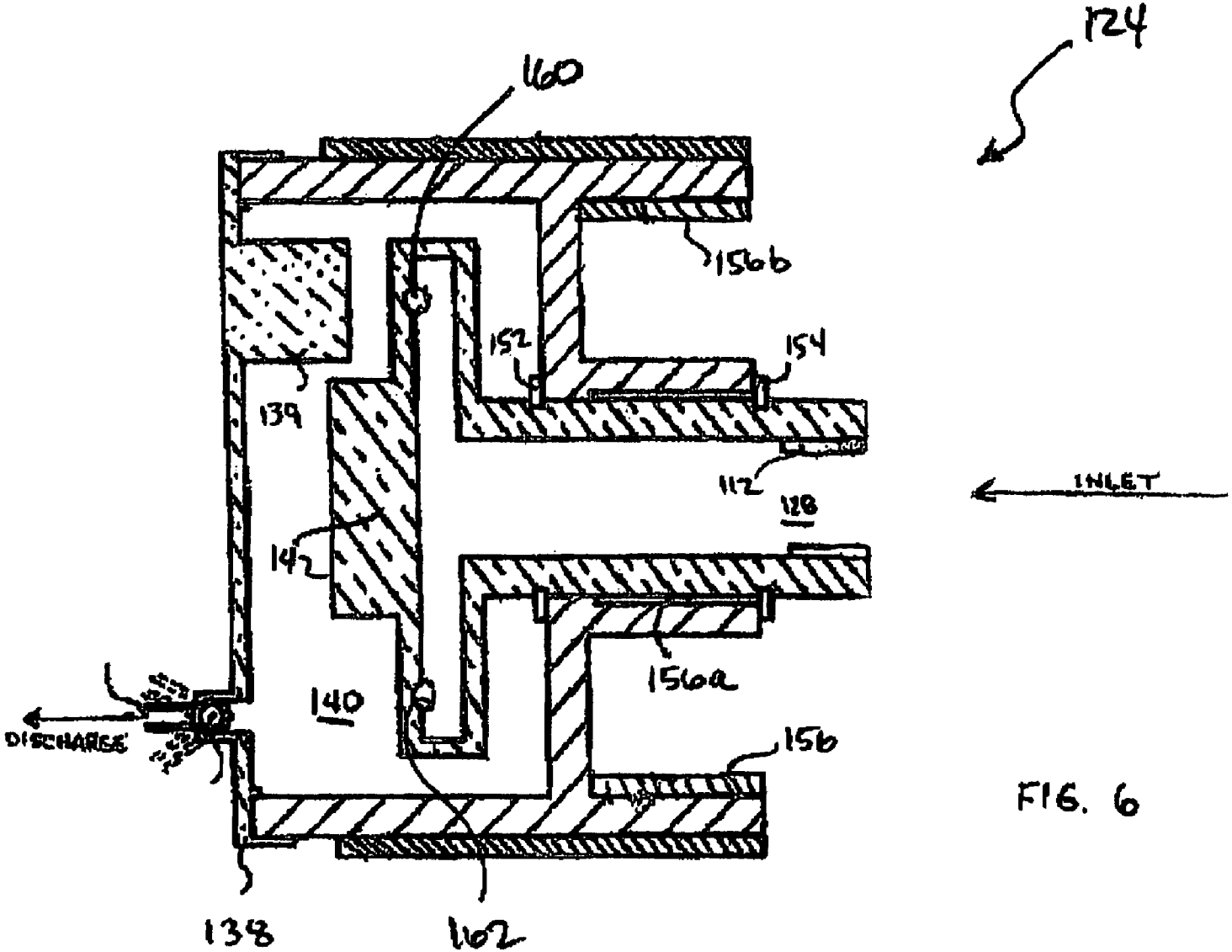
FIG. 6 is a cross sectional view of the exemplary rotating nozzle assembly of FIGS. 5 and 5, taken across the plane IV-IV depicted in FIG. 4.

In accordance with an especially preferred embodiment of the present invention, however, the force for spinning nozzle assembly 124 is provided via the pressurized water stream traversing conduit 112. An exemplary structure adapted to utilize this force is depicted in FIGS. 4-6 and will now be described in detail. As seen in FIG. 4, nozzle assembly 124 comprises a first section 136 and a second section 138 which, when assembled into the configuration shown in FIGS. 5 and 6, define an interior cavity 140 (FIG. 6) within which is disposed a flow diverter assembly indicated generally at 142.

With reference to both FIGS. 4 and 6, it will be seen that flow diverter assembly 142 has a proximal end 144 dimensioned and arranged to receive and retain the distal end 146 of conduit 112. Conduit 112 and flow diverter assembly 142 are fastened together in a conventional manner such, for example, as by a suitable adhesive. As such, fluid diverter assembly 142 is not a moving part but, rather, is stationary despite being disposed within interior cavity 140. Fluid exiting the discharge orifice 128 of conduit 112 enters an inlet 148 defined at the proximal end 144 of flow diverter assembly 142. The center of first section 136 defines an axial opening through which proximal end 144 is inserted. Locking rings indicated generally at 152 and 154 in FIG. 6 prevent axial movement of diverter assembly 142 relative to first section 138. A first bushing indicated generally at 156*a* enables first section to rotate about an axis defined by flow diverter assembly 142. To prevent water from leaking out of interior cavity 140, O-rings or other suitable gaskets may be utilized at the interface between the interior surface of bore 136*a* of first section 136 and the exterior surface of diverter assembly 142. A second bushing, indicated generally at 156*b* is provided to retain and support nozzle assembly 124 at the distal end 114 of device 100 while still allowing it to freely rotate relative thereto.

Defined within the interior axial surface 137 of second section 138 are a plurality of vanes 139. As best seen in FIG. 4, water entering inlet opening 148 of flow diverter assembly 142 exits via a pair of exit openings indicated generally at 160 and 162. As will be readily appreciated by those skilled in the art, exit opening 160 and 162 are dimensioned and arranged so as to cause corresponding jets of liquid to impinge upon the surfaces of vanes 139, thereby initiating rotation of first section 136 and second section 138.

In the illustrative embodiment depicted in FIG. 3A-6, it will be seen that water exits the spinning nozzle assembly 124 via a discharge opening 140 at the distal end of pivotably movable nozzle member 134. As described in connection with the embodiment of FIGS. 1 and 2 above, such a structure is advantageous in that it gives the user a high degree of flexibility in defining the diameter and/or pitch of the spiral stream which is discharged. Of course, if such flexibility is not a design constraint, then it is of course possible to integrally form a nozzle member directly as part of second section 138.

It is believed that the disclosure set forth above encompasses multiple distinct inventions with independent utility. While each of these inventions has been disclosed in illustrative form, the specific embodiments thereof as disclosed and illustrated herein are not to be considered in a limiting sense as numerous variations are possible. By way of illustration, and as indicated earlier, kit forms of the invention may be realized by coupling diverter assembly within a cylindrical adaptor (not shown) having internal threads at one end for securing to the end of a conventional hose nozzle assembly and suitable structure (e.g., bushings and locking rings) on the other end for retaining first section 136 in a way that permits first section 136 to freely rotate. Such a configuration is advantageous since it allows a rotatable nozzle assembly as assembly 124 to be implemented with a wide variety of conventional hose end nozzle structures, and to be attached and detached as desired.

The subject matter of the inventions includes all novel and non-obvious combinations and sub-combinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and sub-combinations of features, functions, elements and/or properties may be claimed in this or a related application. Such claims, whether they are directed to a different invention or directed to the same invention, whether different, broader, narrower or equal in scope to any original claims, are also regarded as included within the subject matter of the inventions of the present disclosure.

What is claimed is:

1. A water discharging amusement device, comprising;

a housing defining an interior chamber;

an inlet conduit dimensioned and arranged to receive water from a source of pressurized water and to direct received pressured water into said interior chamber;

a rotatable nozzle assembly dimensioned and arranged to spin or move while receiving pressurized water from the interior chamber, said rotatable nozzle assembly comprising a pivotable discharge tube defining a discharge opening for ejecting a substantially spiral pattern stream of water therefrom as the rotatable nozzle assembly spins or moves, said pivotable discharge tube being manipulable to select a desired diameter, direction, and pitch of said spiral pattern;

a drive assembly disposed within said chamber and dimensioned and arranged to convert linear forces imparted by pressurized water arriving via said inlet into rotary forces for rotating the rotatable nozzle;

a valve selectively operable between a first position permitting flow of water from the discharge opening and a second position preventing flow of water from the discharge opening; and a hand operated trigger dimensioned and arranged to manipulate the valve into either of the first position and the second position.

2. The amusement device according to claim 1, wherein the drive assembly is disposed proximate said inlet and comprises a turbine including a rotatable or moving disk having a plurality of vanes defined thereon.

3. The amusement device according to claim 2, wherein said inlet conduit includes a first portion defining a first bore having a first diameter dimensioned for threaded engagement with a garden hose and a second portion defining a second bore having a second diameter substantially smaller than said first diameter, the second portion operating to limit a rate at which water enters said interior chamber and impinges upon the vanes of said turbine.

4. The amusement device according to claim 3, wherein the second diameter is smaller than a diameter of the discharge opening of the rotatable and or movable nozzle assembly.

5. The amusement device of claim 2, wherein a peripheral surface of said rotatable or movable disk defines a first plurality of teeth and wherein said drive assembly further includes a driven gear defining a second plurality of teeth dimensioned and arranged for driven engagement with teeth of said rotatable or movable disk.

6. The amusement device of claim 5, wherein said driven gear further includes a shaft dimensioned and arranged to extend though a bore in a sidewall of said housing and to freely rotate within said bore, said shaft being coupled to said rotatable nozzle assembly for rotation therewith and defining a discharge conduit extending therethrough for establishing fluid communication between said interior chamber and a discharge opening of said rotatable and or movable nozzle assembly.

7. The amusement device according to claim 1, wherein said inlet conduit includes a first portion defining a first bore having a first diameter dimensioned for threaded engagement with a garden hose and a second portion defining a second bore having a second diameter substantially smaller than said first diameter, the second portion operating to limit a rate at which water enters said interior chamber.

8. The amusement device according to claim 7, wherein said second diameter is smaller than a diameter of the discharge opening of the rotatable or movable nozzle assembly.

9. The amusement device of claim 1, wherein said amusement device is a water sprinkler and said housing defines a base dimensioned and arranged for supporting said rotatable or movable nozzle assembly in a substantially vertical orientation.

10. The amusement device of claim 1, wherein said housing further defines a handle portion and a barrel portion and said inlet conduit is dimensioned and arranged for threaded engagement to an end of a garden hose and for directing received pressured water into said housing.

11. A method of discharging water, along a spiral or motion pattern discharge path, from the amusement device of claim 10, comprising the steps of:

threadably securing rotatable and or movable nozzle assembly proximate the distal end of the hose end nozzle;

depressing the trigger to cause water to flow into the rotatable or movable nozzle assembly, thereby causing the rotatably and or movable nozzle assembly to rotate and or move relative to the housing, and to thereby discharge water along a spiral water pattern path.

12. The method of claim 11, further comprising manipulating a pivotable discharge tube extending from the rotatable or movable nozzle assembly from a first position to a second position, whereby discharge along a modified spiral pattern path is obtained.

13. A water discharging amusement device, comprising;

an inlet conduit dimensioned and arranged to receive water from a source of pressurized water, wherein said inlet conduit includes a first portion defining a first bore having a first diameter dimensioned for receiving the water from the source of pressurized water and a second portion defining a second bore having a second diameter substantially smaller than said first diameter;

a rotatable nozzle assembly dimensioned and arranged to spin or move while receiving pressurized water from the inlet conduit, the rotatable nozzle assembly comprising a discharge tube defining a discharge opening for ejecting a substantially spiral stream of water therefrom as the rotatable nozzle assembly spins; and a drive assembly dimensioned and arranged to convert linear forces imparted by the water arriving from said inlet conduit into rotary forces for rotating the rotatable nozzle, wherein the second diameter of the second portion of the inlet is dimensioned to limit the flow rate at which water enters the rotatable nozzle assembly and the drive assembly is configured so that a rotational speed of the nozzle produced by the flow rate of water arriving from said inlet conduit is in a range of rotational speeds that ejects a substantially spiral stream of water.

14. The water discharging amusement device of claim 13, wherein said discharge tube is pivotable, said pivotable discharge tube being manipulable to select a desired diameter, direction, and pitch of said spiral pattern.

15. The water discharging amusement device of claim 13, wherein said discharge opening has a discharge diameter that is larger than the second diameter of the second portion of the inlet.

16. The water discharging amusement device of claim 13, wherein the drive assembly includes the discharge tube dimensioned and arranged to produce a nozzle reaction force causing rotation of the rotatable nozzle assembly as the stream of water is discharged from the discharge opening.

17. The water discharging amusement device of claim 13, further comprising a housing defining an interior chamber, wherein said inlet conduit directs received water into the interior chamber and the rotatable nozzle assembly receives water from the interior chamber, said drive assembly being disposed in the interior chamber.

18. The water discharging amusement device of claim 13, wherein the rotatable nozzle assembly rotates about an axis of rotation and has a front end and a rear end, the discharge tube extends in a discharge direction that is not perpendicular to the axis of rotation and is at least partially toward the front of the rotatable nozzle assembly.

* * * * *